US011505931B2

(12) United States Patent
Cheng

(10) Patent No.: US 11,505,931 B2
(45) Date of Patent: Nov. 22, 2022

(54) DRAIN STRAINER

(71) Applicant: Hsi-Min Cheng, Taichung (TW)

(72) Inventor: Hsi-Min Cheng, Taichung (TW)

( * ) Notice: Subject to any disclaimer, the term of this patent is extended or adjusted under 35 U.S.C. 154(b) by 0 days.

(21) Appl. No.: 17/330,480

(22) Filed: May 26, 2021

(65) Prior Publication Data

US 2022/0251813 A1 Aug. 11, 2022

(30) Foreign Application Priority Data

Feb. 8, 2021 (TW) ..... 110104784

(51) Int. Cl.
*E03C 1/264* (2006.01)

(52) U.S. Cl.
CPC ..... *E03C 1/264* (2013.01)

(58) Field of Classification Search
CPC ..... E03C 1/262; E03C 1/264; E03C 1/26
USPC ..... 4/291, 290, 292, 289, 288
See application file for complete search history.

(56) References Cited

U.S. PATENT DOCUMENTS 1,292,856 A * 1/1919 Niblo ..... E03C 1/262 4/652
1,449,300 A * 3/1923 Scott ..... E03C 1/264 4/291
1,950,817 A * 3/1934 Rossman ..... E03C 1/264 4/291
1,996,279 A * 4/1935 Dillon ..... E03C 1/264 D23/209
6,067,669 A * 5/2000 Peterson ..... E03C 1/262 4/291
6,088,844 A * 7/2000 Killham ..... E03C 1/262 4/295
9,060,656 B2 * 6/2015 Tong ..... E03C 1/23
11,019,965 B2 * 6/2021 Beck ..... E03C 1/22
2010/0071122 A1 3/2010 Li
2013/0185857 A1 7/2013 Worth et al.
2015/0292191 A1 * 10/2015 Cheng ..... E03C 1/264 210/153
2018/0274218 A1 9/2018 Karnegie et al.
2021/0395986 A1 * 12/2021 Ahuja ..... E03C 1/262

FOREIGN PATENT DOCUMENTS

TW M479329 U 6/2014
TW 202012748 A 4/2020

OTHER PUBLICATIONS

Search Report appended to an Office Action, which was issued to Taiwanese counterpart application No. 110113831 by the TIPO dated Dec. 24, 2021 with an English translation thereof.
Search Report issued to European counterpart application No. 21174934.6 by the EPO dated Nov. 11, 2021.

* cited by examiner

*Primary Examiner* — Benjamin R Shaw
(74) *Attorney, Agent, or Firm* — Burris Law, PLLC

(57) ABSTRACT

A drain strainer includes a base body defining a chamber with opposite water inlet and water outlet, a straining unit disposed in the chamber, and a cover unit including a cover body connected to the straining unit. The straining unit includes a bottom straining member having a plurality of bottom straining holes, and a main straining member disposed on one side of the bottom straining member and including a main straining surrounding wall formed with a plurality of spaced-apart main straining holes. The bottom and main straining holes communicate with each other and with the chamber.

14 Claims, 17 Drawing Sheets

DRAIN STRAINER

CROSS-REFERENCE TO RELATED APPLICATION

This application claims priority of Taiwanese Patent Application No. 110104784, filed on Feb. 8, 2021.

FIELD

The disclosure relates to a drainage equipment, more particularly to a drain strainer.

BACKGROUND

An existing strainer generally includes a seat body connected to a drain pipe, and a drain cover covering the seat body and provided with a plurality of through holes for filtering hair and other foreign objects when water flows therethrough so as to prevent the same from being discharged into the drain pipe which can cause blockage or clogging.

However, the existing strainer is usually made of stainless steel, which is different from the stone, tile or other floor materials often used in interior design, and thus affects the integrity and consistency of the interior design appearance. Further, the filtered hair and other foreign objects are exposed on the drain cover, thereby making the environment appears more dirty. Additionally, water will accumulate on top of the drain cover because it is covered with the filtered hair and other foreign objects, so that there is need to frequently clean the existing strainer.

For the existing strainer to operate smoothly, the through holes in the drain cover are usually made large. However, the hair and the smaller foreign objects can flow along with the water into the drain pipe, thereby clogging the drain pipe. Further, when removing the hair, because a portion of the hair will flow along with the water to the bottom of the drain cover, and the remaining portion thereof will be left on the drain cover, the hair are easily entangled or stuck in the through holes, thereby causing inconvenience during cleaning of the existing strainer.

Currently, a commercially available strainer for a wash basin is provided with an openable water storage cover disposed above a drain hole of the wash basin to provide a water storage function. When it is necessary to store water, the water storage cover is closed; and, when it is necessary to allow flow of the water, the water storage cover is opened, and the water will flow through a gap between the water storage cover and the wash basin. However, this kind of strainer for the wash basin almost has no filtering function, so that it is easy to cause clogging. Generally, the wash basin in an outdoor or public place rarely use the water storage function, so that the commercially available strainer for the wash basin does not meet the requirements of the outdoor or public place.

A drainage head, as disclosed in Taiwanese Patent No. M479329U, includes a seat body, a drain plate disposed on the seat body, and a drain cover connected to and covering a large portion of the drain plate. When water passes through the drainage head, hair and other foreign objects will be filtered and accumulated between the drain plate and the drain cover, and are covered by the drain cover, so that a clean appearance can be maintained. Further, a top surface of the drain cover may be made of a marble or ceramic tile which can improve the overall appearance. However, the drainage head cannot solve the problem of easy clogging of the drain pipe, so it still has room for improvement.

SUMMARY

Therefore, an object of the present disclosure is to provide a drain strainer that is capable of alleviating at least one of the drawbacks of the prior art.

Accordingly, a drain strainer of the present disclosure comprises a base, a straining unit and a cover unit. The base has a base body defining a chamber. The chamber has a water inlet and a water outlet opposite to each other along a top-bottom direction. The straining unit is disposed in the chamber and includes a bottom straining member proximate to the water outlet and having a plurality of bottom straining holes extending therethrough, and a main straining member disposed on one side of the bottom straining member that is distal to the water outlet. The main straining member includes a main straining surrounding wall formed with a plurality of spaced-apart main straining holes that extend the re through. The bottom straining holes and the main straining holes communicate with each other and with the chamber. The cover unit includes a cover body connected to the straining unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
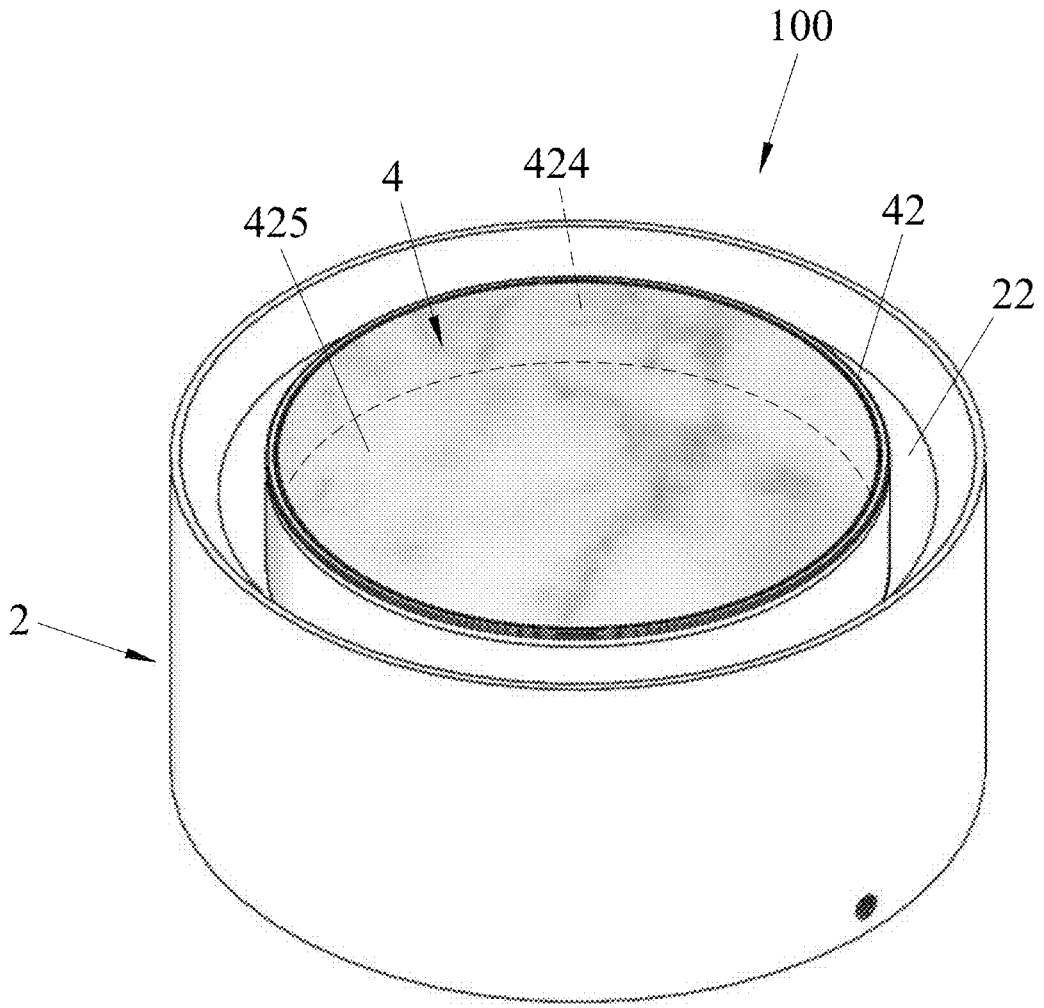
FIG. 1 is a perspective view of a drain strainer according to the first embodiment of the present disclosure.

Before the present disclosure is described in greater detail, it should be noted that like elements are denoted by the same reference numerals throughout the disclosure.

Figure 2:
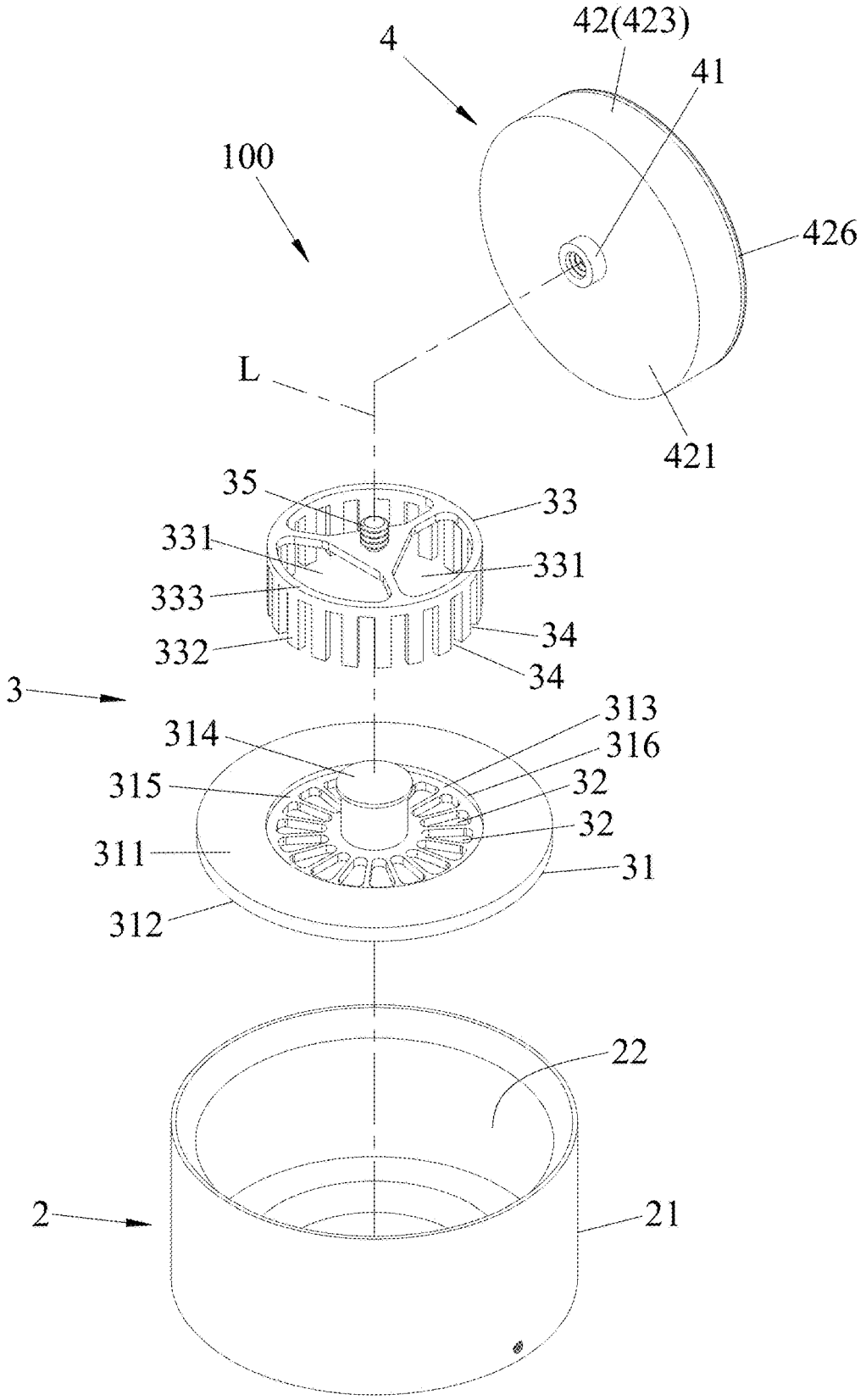
FIG. 2 is an exploded perspective view of the first embodiment.
Figure 3:
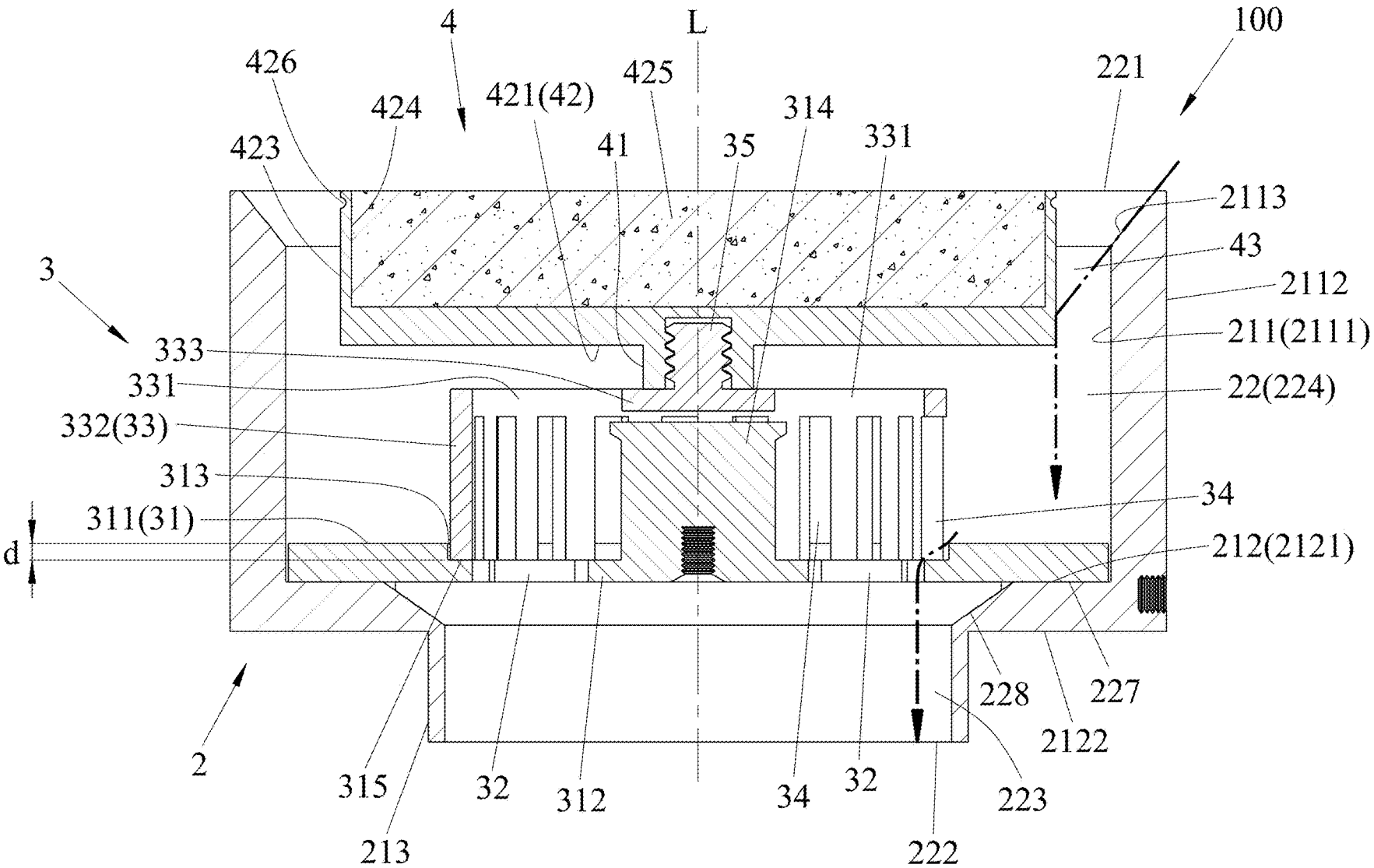
FIG. 3 is an assembled sectional view of the first embodiment.

Referring to FIGS. 1 to 3, a drain strainer 100 according to the first embodiment of the present disclosure is suitable to be disposed in a drain opening (not shown) of a ground surface (not shown) and is located above a drain pipe (not shown). The drain strainer 100 comprises a base 2, a straining unit 3, and a cover unit 4.

The base 2 has a cylindrical base body 21 that is configured to be disposed in the drain opening, that extends along a top-bottom direction (L), and that defines a chamber 22. The base body 21 includes a base surrounding wall 211 extending along the top-bottom direction (L), and a base bottom wall 212 extending inwardly and radially from a bottom periphery of the base surrounding wall 211. The base surrounding wall 211 has an inner surface 2111, an outer surface 2112 opposite to the inner surface 2111, and a top edge surface 2113 tapering downwardly from a top periphery of the outer surface 2112 to a top periphery of the inner surface 2111. The base bottom wall 212 has an inner surface 2121 facing the chamber 22, an outer surface 2122 opposite to the inner surface 2121, and a tapered hole 228 that extends through the inner surface 2121 and the outer surface 2122, that tapers downwardly from the inner surface 2121 to the outer surface 2122, and that communicates with the chamber 22. The base body 21 further includes an annular extension 213 extending downwardly from the outer surface 2122 of the base bottom wall 212 and corresponding in position to the tapered hole 228.

The chamber 22 has a water inlet 221 and a water outlet 222 opposite to each other along the top-bottom direction (L), and includes a lower chamber portion 223, an upper chamber portion 224, and a shoulder 227. The water inlet 221 is defined by the top edge surface 2113 of the base surrounding wall 211. The lower chamber portion 223 is defined by the annular extension 213, and has the water outlet 222. The upper chamber portion 224 communicates with the lower chamber portion 223 through the tapered hole 228, is defined by the inner surface 2111 of the base surrounding wall 211, and has the water inlet 221. The shoulder 227 is between the lower and upper chamber portions 223, 224, and corresponds to the base bottom wall 212. The lower chamber portion 223 has a diameter smaller than a diameter of the upper chamber portion 224.

The straining unit 3 is disposed in the chamber 22, and includes a bottom straining member 31, a main straining member 33, and an engaging portion 35. The bottom straining member 31 is removably disposed on the base bottom wall 212, abuts against the inner surface 2121 of the base bottom wall 212, and is proximate to the water outlet 222. The bottom straining member 31 has an outer diameter substantially the same as an inner diameter of the base surrounding wall 211. Further, the bottom straining member 31 is circular, and has a top surface 311, a bottom surface 312 opposite to the top surface 311, and a groove 313 extending inwardly from a central portion of the top surface 311 and defined by a groove bottom wall 315 and a groove surrounding wall 316. The groove bottom wall 315 is formed with a plurality of bottom straining holes 32 extending therethrough. In this embodiment, each bottom straining hole 32 is configured as an elongated hole extending in a radial direction perpendicular to the top-bottom direction (L).

The top surface 311 and the groove bottom wall 315 have a height difference (d), as shown in FIG. 3. Further, in this embodiment, the bottom straining member 31 further has a grip portion 314 protruding from the groove bottom wall 315 along the top-bottom direction (L) and surrounded by the bottom straining holes 32. In an alternative embodiment, the bottom straining member 31 may not be formed with a groove, but the top surface 311 thereof may be provided with two spaced-apart annular protrusions surrounding the bottom straining holes 32.

The main straining member 33 is disposed on one side of the bottom straining member 31 that is distal to the water outlet 222, and includes a main straining surrounding wall 332, and a main straining top wall 333 connected to one side of the main straining surrounding wall 332 that is opposite to the bottom straining member 31. The main straining surrounding wall 332 is positioned in the groove 313 adjacent to the groove surrounding wall 316, and is formed with a plurality of main straining holes 34 that extend therethrough, that are angularly spaced apart from each other, and that extend in an axial direction parallel to the top-bottom direction (L). The bottom straining holes 32 and the main straining holes 34 communicate with each other and with the chamber 22. In this embodiment, the main straining top wall 333 is formed with three angularly spaced-apart overflow holes 331 located above and communicating with the main straining holes 34.

In this embodiment, the engaging portion 35 is provided on a central portion of the main straining top wall 333 for engagement with the cover unit 4, and has an external thread.

The cover unit 4 includes a cover body 42 and a connecting portion 41 extending outwardly from the cover body 42. In this embodiment, the cover body 42 is disposed in the chamber 22, and partially covers the straining unit 3. The cover body 42 includes a cover bottom wall 421, and a cover surrounding wall 423 extending upwardly from an outer periphery of the cover bottom wall 421. The cover bottom wall 421 and the cover surrounding wall 423 cooperatively define a filling space 424 that is suitable to be filled with a filler 425 of the same material as the ground surface. In this embodiment, the filler 425 is a tile, but is not limited thereto.

The cover surrounding wall 423 has an annular recess 426 formed in an outer surface thereof and proximate to a top end thereof. The outer surface of the cover surrounding wall 423 cooperates with the inner surface 2111 of the base surrounding wall 211 to define an annular water passage 43 corresponding to the water inlet 221. The cover surrounding wall 423 has a smallest diameter greater than an outer diameter of the main straining member 33. An extending direction of the top edge surface 2113 of the base surrounding wall 211 toward the water outlet 222 (see two-dot chain line in left side of FIG. 4) intersects with the cover surrounding wall 423.

The connecting portion 41 is tubular, and extends downwardly from a central portion of the cover bottom wall 421. In this embodiment, the connecting portion 41 has an internal thread connected to the external thread of the engaging portion 35 of the straining unit 3.

With reference to FIGS. 2 and 3, when water is to be discharged through the drain strainer 100 (see one-dot chain line in right side of FIG. 3), the water will first flow through the water inlet 221, and is guided by the top edge surface 2113 of the base surrounding wall 211 and the cover surrounding wall 423 to flow through the water passage 43 into the chamber 22. Because the bottom straining holes 32 are provided in the groove bottom wall 315, the water can only flow from the main straining holes 34 to the bottom straining holes 32, and from the bottom straining holes 32 to the water outlet 222 and out into the drainpipe (not shown).

Figure 4:
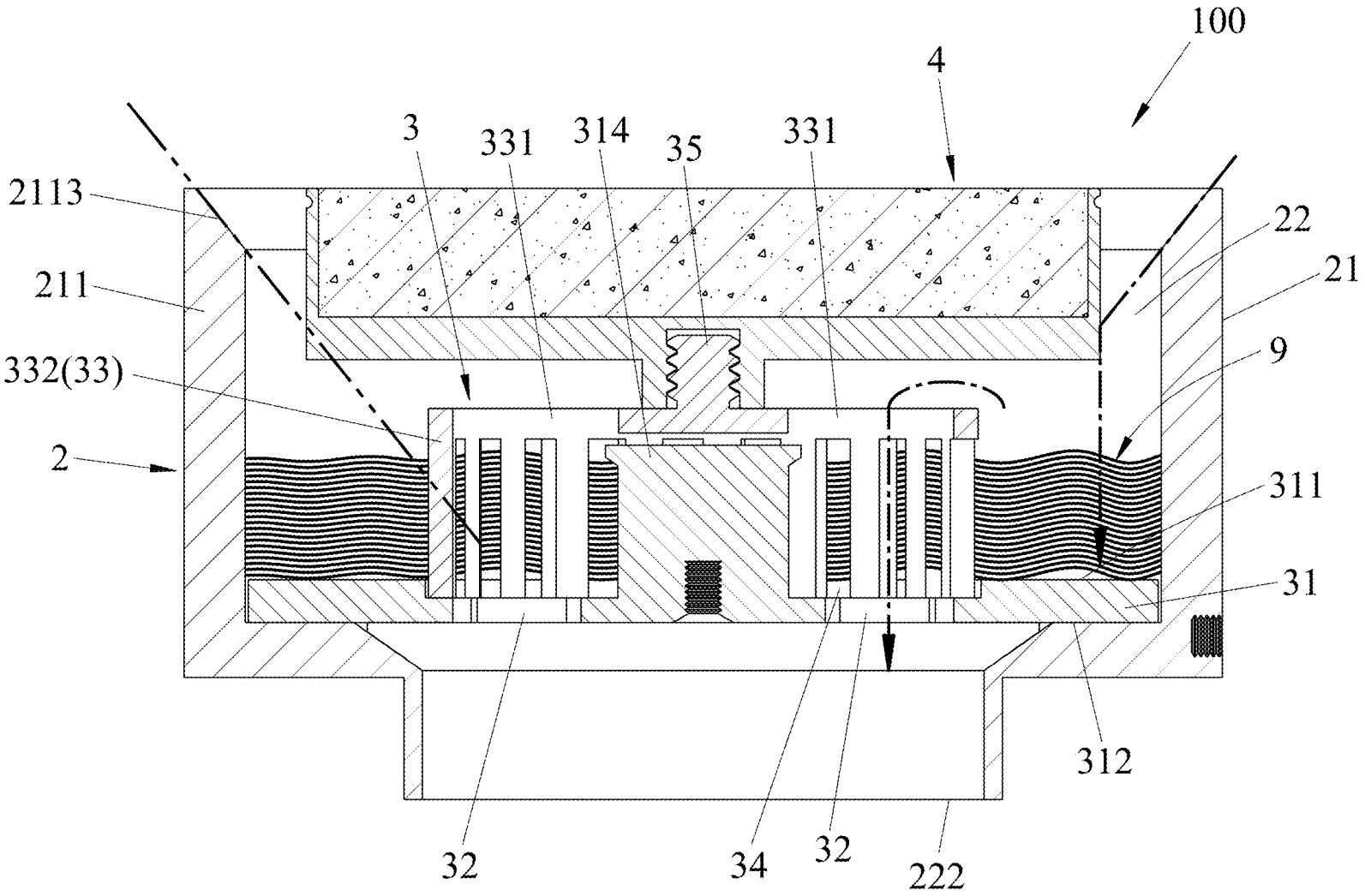
FIG. 4 is a view similar to FIG. 3, but illustrating how water may flow when a plurality of main straining holes of the first embodiment are clogged.

Referring to FIG. 4, in combination with FIG. 2, when hair 9 in the water is filtered by the main straining holes 34, is accumulated on the top surface 311 of the bottom straining member 31 within the chamber 22, and surrounds the main straining surrounding wall 332, causing the main straining holes 34 to be clogged, the water is temporarily accumulated on the top surface 311 of the bottom straining member 31 until the height of the accumulated water is higher than the main straining surrounding wall 332, after which the water will flow through the overflow holes 331, the bottom straining holes 32, the water outlet 222, and out into the drain pipe (not shown).

Therefore, two filtering or straining functions can be achieved using the drain strainer 100 of this disclosure.

Figure 5:
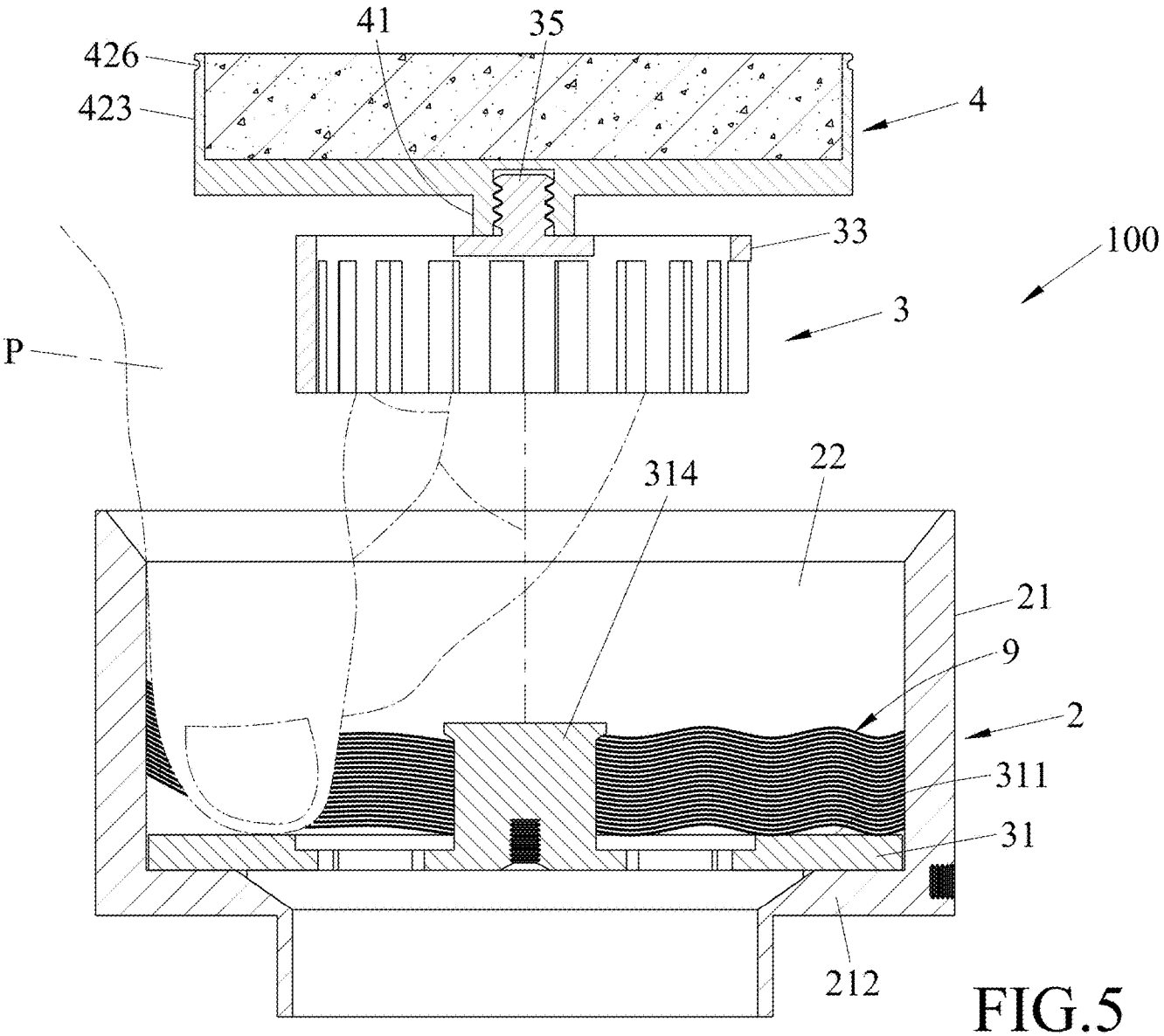
FIG. 5 is a sectional view, illustrating a cleaning method of the first embodiment.

Referring to FIG. 5, to clean the drain strainer 100, fingers of a user (P) are first inserted into the water passage 43 through the water inlet 221 to grip the cover surrounding wall 423, after which the cover unit 4 is then pulled upward and away from the base 2, bringing along the main straining member 33. Through the disposition of the annular recess 426, tips of the fingers of the user (P) can be inserted into the annular recess 426 to easily exert force on the cover unit 4. Next, the fingers of the user (P) are inserted into the chamber 22 to remove the hair 9 accumulated on the top surface 311 of the bottom straining member 31. Thus, it is very convenient to clean the drain strainer 100.

Because the bottom straining member 31 is provided below the main straining member 33, when the main straining member 33 is moved upward, the filtered hair 9 is prevented from falling into the drain pipe which can cause clogging. Moreover, because the bottom straining member 31 is removably disposed on the base bottom wall 212, if there is a need to clean the drain pipe, the grip portion 314 of the bottom straining member 31 is simply pulled upward using the bare hand of the user (P) to move the bottom straining member 31 away from the base bottom wall 212, thereby exposing the drainpipe to facilitate the cleaning thereof. Thus, it is easy to remove the bottom straining member 31 from the base bottom wall 212, and the subsequent installation thereof is also very simple.

From the aforesaid description, the drain strainer 100 of this embodiment has the following advantages:

1. Since the smallest diameter of the cover surrounding wall 423 is greater than the outer diameter of the main straining member 33, and since the extending direction of the top edge surface 2113 of the base surrounding wall 211 toward the water outlet 222 intersects with the cover surrounding wall 423, when water flows into the drain strainer 100 through the water inlet 221, it will be guided by the top edge surface 2113 of the base surrounding wall 211 and the cover surrounding wall 423 to flow into the chamber 22, after which the water passes through the main straining holes 34 and the bottom straining holes 32, so that clogging of the drain pipe can be reduced.

2. Since the extending directions of the main straining holes 34 and the bottom straining holes 32 are different, the filtering or straining effect of this disclosure can be enhanced, thereby reducing the clogging of the drain pipe.

3. Through the disposition of the overflow holes 331, when the main straining holes 34 are clogged, water will pass through the overflow holes 331 and the bottom straining holes 32 and out into the drain pipe. Hence, the two filtering or straining functions of this disclosure can still be maintained.

4. Since the main straining member 33 is removably disposed on the bottom straining member 31, and the connecting portion 41 of the cover unit 4 is threadedly connected to the engaging portion 35 of the straining unit 3, it is only necessary to pull upward the cover unit 4 so as to bring the main straining member 33 therealong, after which the fingers of the user (P) can be directly inserted into the chamber 22 to remove the filtered hair 9. Further, because the bottom straining member 31 is provided below the main straining member 33, when the main straining member 33 is moved upward, the filtered hair 9 can be prevented from falling into the drain pipe which can cause clogging.

5. Since the bottom straining member 31 is removably disposed on the base bottom wall 212, if there is a need to clean the drain pipe, the bottom straining member 31 can be removed using the bare hand of the user (P). Thus, removal of the bottom straining member 31 from the base bottom wall 212 is easy, and the subsequent installation thereof is also very simple.

6. Since the main straining surrounding wall 332 extends along the top-bottom direction (L) and is provided with the main straining holes 34, when the hair 9 in the water is filtered by the main straining holes 34, the hair 9 will gradually accumulate above the top surface 311 of the bottom straining member 31 and surround the main straining surrounding wall 332, so that the amount of hair 9 that can be accumulated using the drain strainer 100 of this disclosure is greater than the amount of hair that can be accumulated using the existing drain strainer with a horizontally arranged drain plate (not shown). Thus, the number of cleaning using the drain strainer 100 of this disclosure can be reduced.

7. Since the cover body 42 is not similar to the drain cover of the existing drain strainer which has many holes, water must flow below the cover body 42 and pass through the water passage 43 before it is filtered, so that hair 9 or debris can be prevented from staying on top of the cover body 42 which can affect the cleanliness and appearance of the disclosure.

Figure 7:
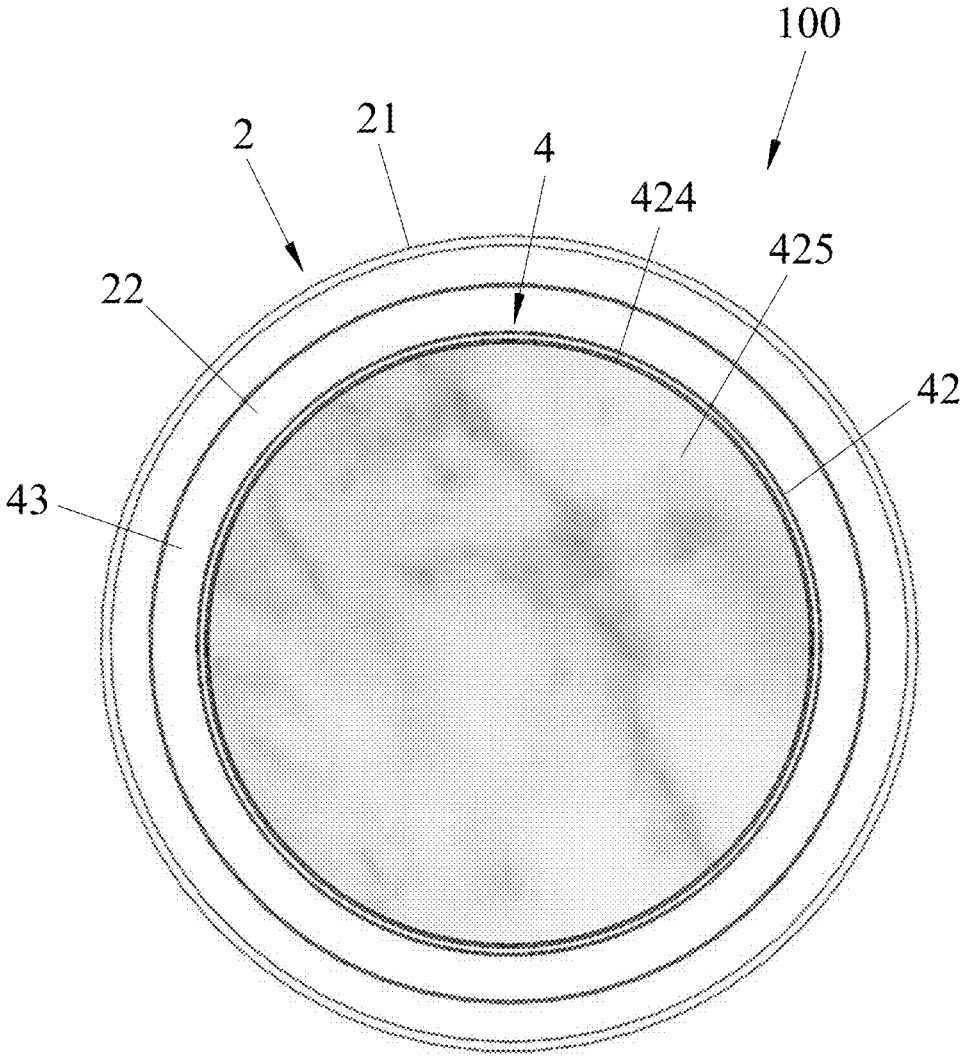
FIG. 7 is a schematic top view of the first embodiment.

8. Since the smallest diameter of the cover surrounding wall 423 is greater than the outer diameter of the main straining member 33, when the drain strainer 100 is viewed from the top (see FIG. 7), only the filler 425, the annular water passage 43, and a small portion of the cover body 21 are visible, while the main straining member 33 is hidden. Further, since the filler 425 receives in the filling space 424 has the same material as the ground surface, an overall appearance of the drain strainer 100 is consistent with the surrounding environment, so that the appearance of the drain strainer 100 is very simple and beautiful.

Figure 6:
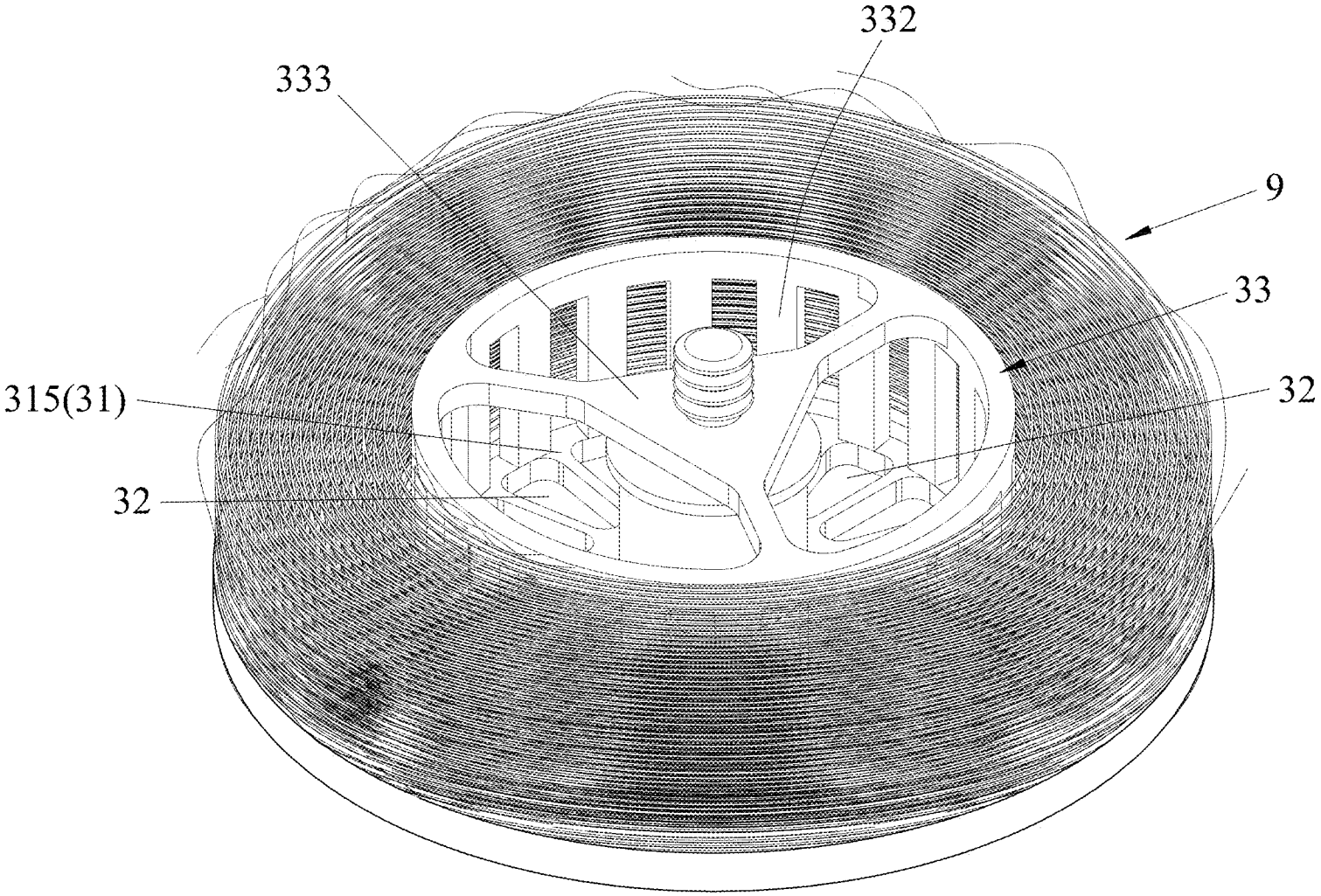
FIG. 6 is a perspective view, illustrating how hair evenly surrounds a main straining member of the first embodiment.

9. When water flows into a cylindrical space between the cover body 42 and the bottom straining member 31, based on the physical characteristics of flowing water, the water will forma vortex in the cylindrical space, so that the water moves continuously in a circular motion. Through this, hair 9 in the water will surround the main straining surrounding wall 332 in a uniform manner (see FIG. 6) and gather into one body of annular shape, and the hair 9 will hardly pass through the main straining holes 34. Therefore, during cleaning of the drain strainer 100, it is only necessary to pull upward the main straining member 33, and the gathered hair 9 can be easily taken out from the main straining surrounding wall 332 or from the top of the bottom straining member 31. Thus, the drain strainer 100 can be conveniently and efficiently cleaned.

10. Since the connecting portion 41 of the cover unit 4 is threadedly connected to the engaging portion 35 of the straining unit 3, the cover unit 4 and the straining unit 3 can be disassembled and cleaned separately, if necessary.

It should be noted that, in this embodiment, the filling space 424 of the cover body 42 can be filled with the filler 425 having the same material as the ground surface, but is not limited thereto. During implementation, the filler 425 may be changed to a material different from that of the ground surface according to the installation location or the design plan, or the cover body 42 may not be provided with the filling space 424.

Figure 8:
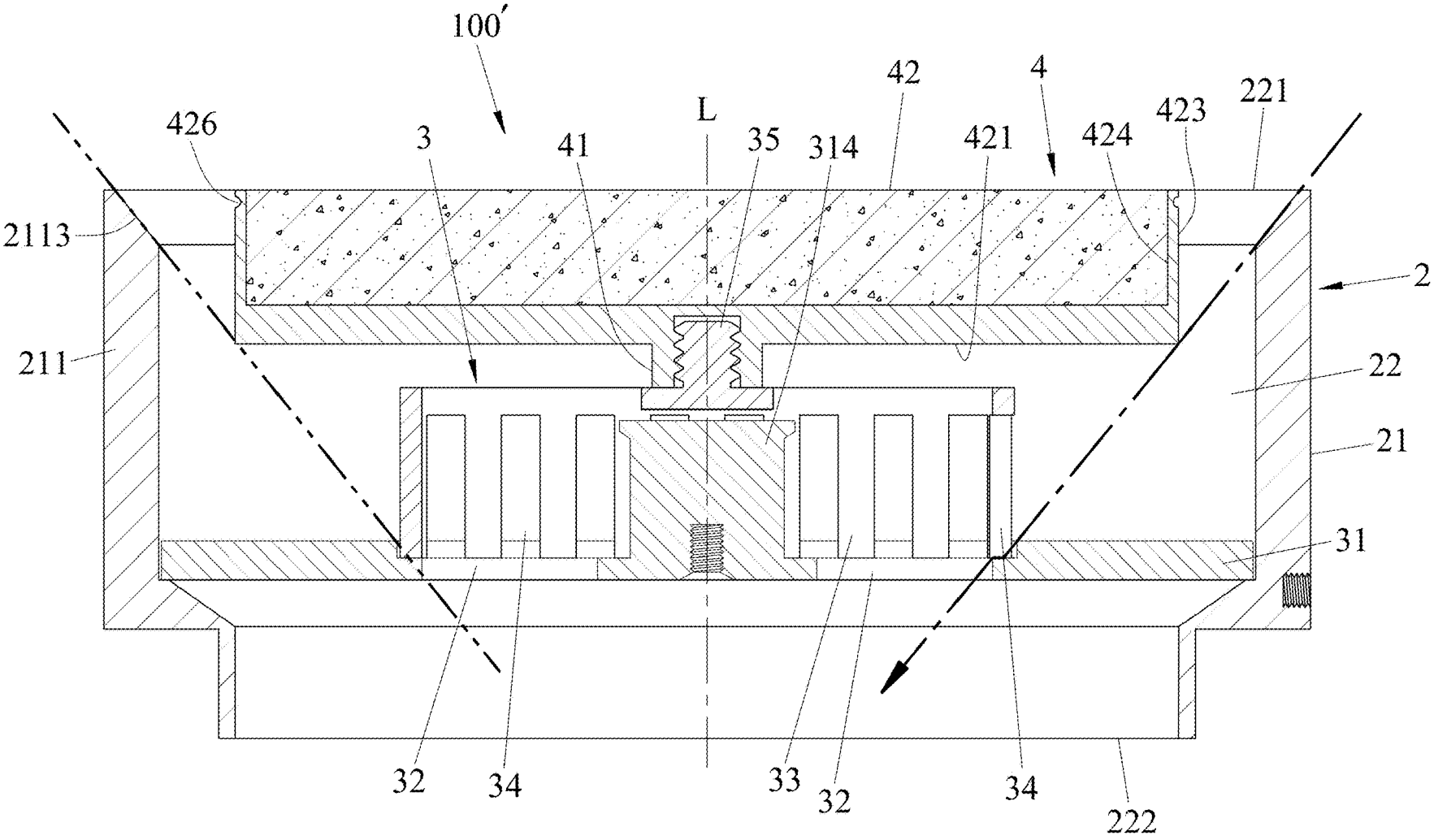
FIG. 8 is a sectional view of a drain strainer according to the second embodiment of the present disclosure.

Referring to FIG. 8, the second embodiment of the drain strainer 100' of this disclosure is shown to be identical to the first embodiment, but differs in that, in the second embodiment, the extending direction of the top edge surface 2113 of the base surrounding wall 211 toward the water outlet 222 (see two-dot chain line in left side of FIG. 8) intersects with a junction of the cover surrounding wall 423 and the cover bottom wall 421 and a junction of the main straining member 33 and the bottom straining member 31. Through this, water can flow along the top edge surface 2113 of the base surrounding wall 211 toward the water outlet 222, and pass through the main straining holes 34 and the bottom straining holes 32 to flow out of the water outlet 222. Therefore, the draining efficiency of the second embodiment is better than that of the first embodiment. The advantages of the first embodiment can be similarly achieved using the second embodiment.

Figure 9:
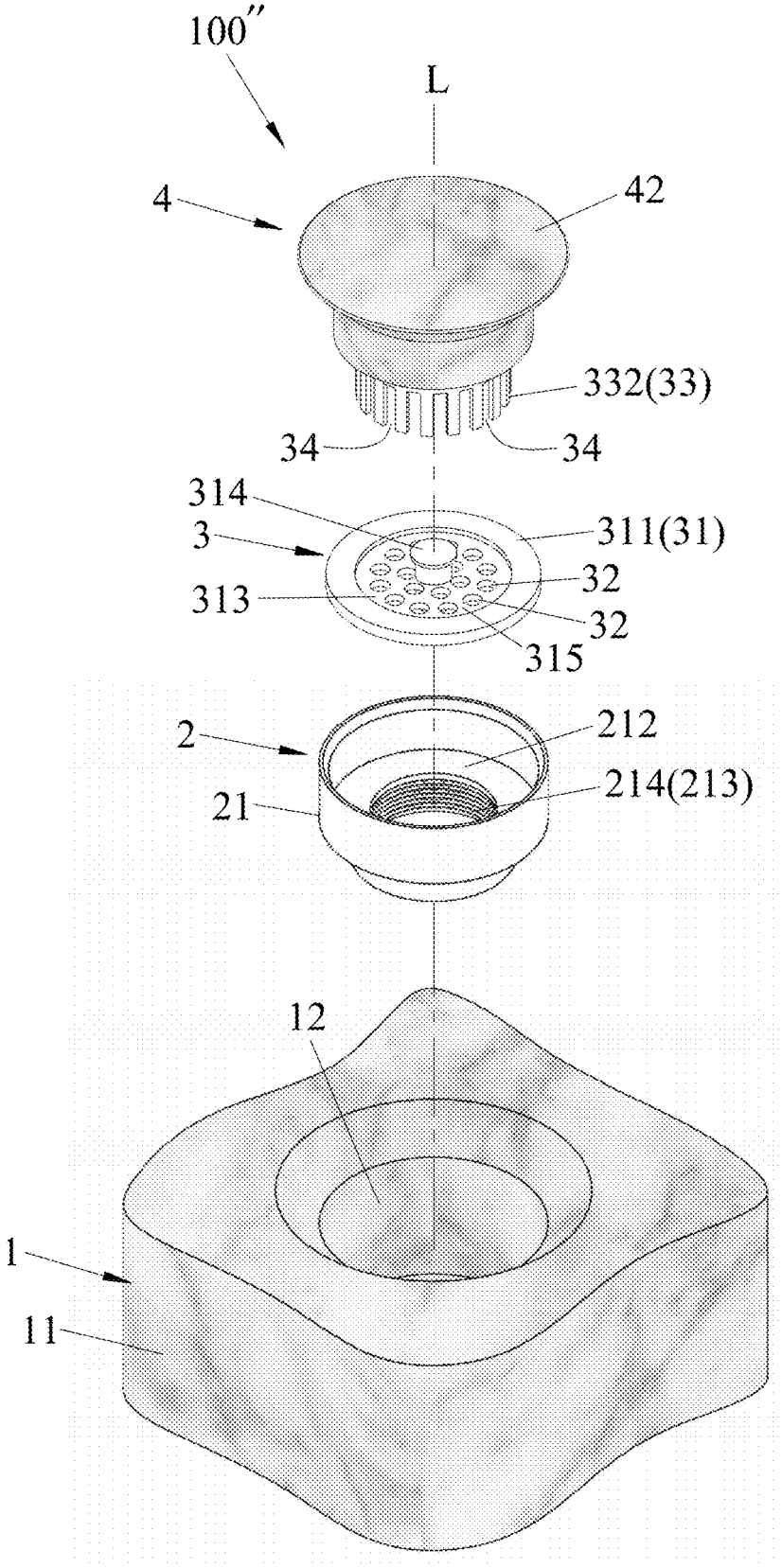
FIG. 9 is an exploded perspective view of a drain strainer according to the third embodiment of the present disclosure.
Figure 10:
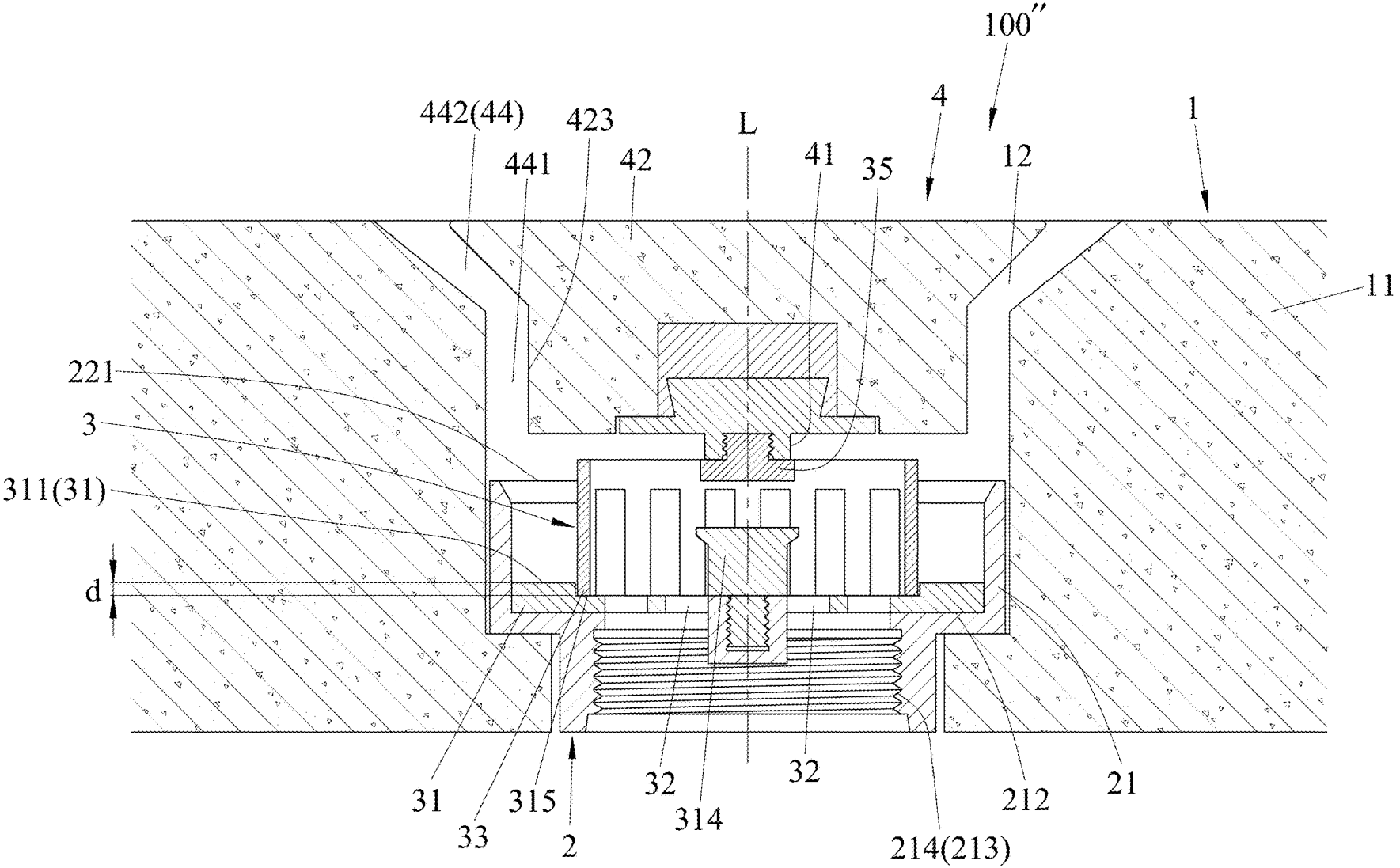
FIG. 10 is an assembled sectional view of the third embodiment.
Figure 11:
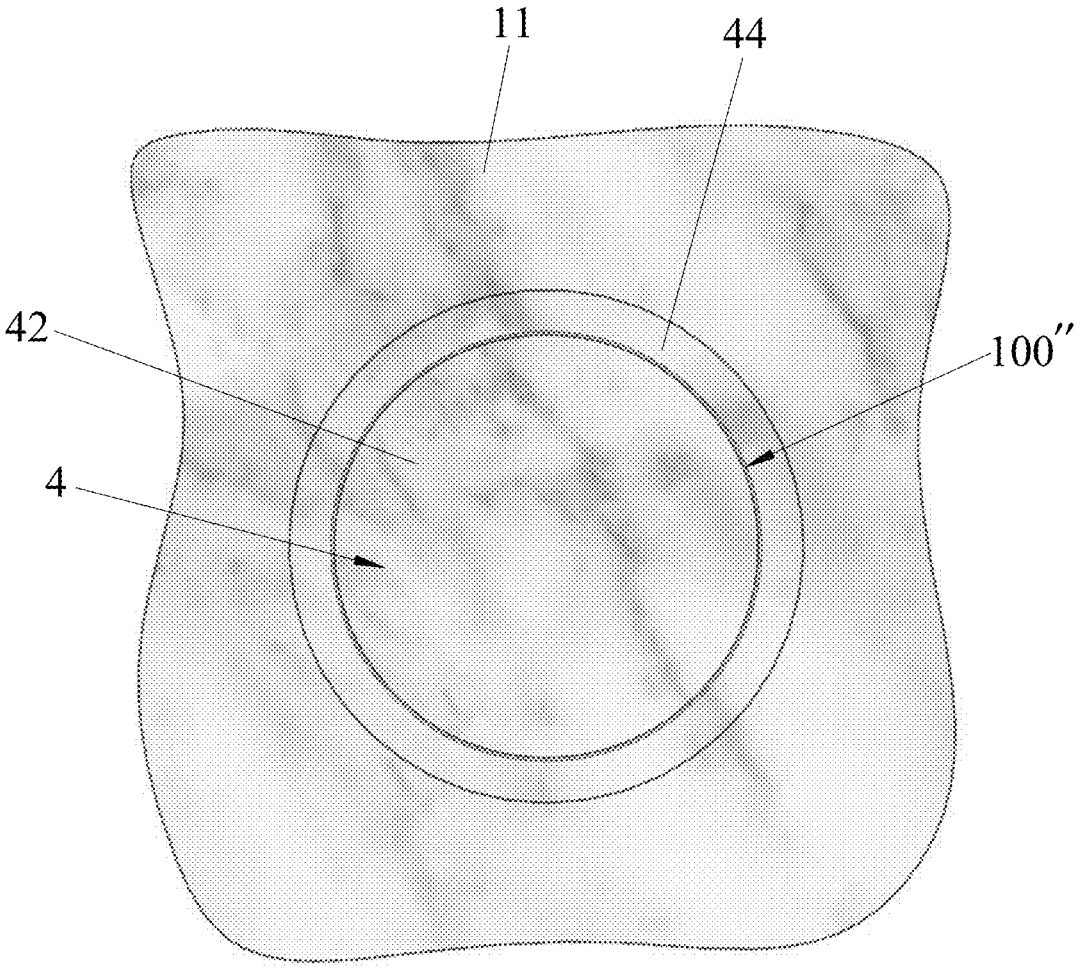
FIG. 11 is a schematic top view of the third embodiment.

Referring to FIGS. 9 to 11, the third embodiment of the drain strainer 100" of this disclosure is shown to be identical to the first embodiment, but differs in that, the drain strainer 100" of the third embodiment is suitable to be disposed in a drain opening 12 of a sink body 11 of a sink 1, and is suitable for connection with the drain pipe. The sink body 11 is made of marble.

The base 2 of the drain strainer 100" is disposed on a bottom portion of the drain opening 12. The annular extension 213 of the base body 21 has an internal thread 214 for threaded connection with the drain pipe.

In this embodiment, each bottom straining hole 32 is configured as a circular hole, and the cover unit 4 is disposed externally of the chamber 22 and is located on a top portion of the drain opening 12. The cover body 42 is made of a material similar to that of the sink body 11, and has a largest diameter greater than a largest diameter of the base body 21. The cover body 42 cooperates with the sink body 11 to define an annular guide passage 44 communicating with the water inlet 221. The guide passage 44 has a vertical passage portion 441 extending along the top-bottom direction (L) and adjacent to the cover surrounding wall 423, and an inclined passage portion 442 extending upwardly, outwardly and inclinedly from the vertical passage portion 441. A width of one end of the inclined passage portion 442 that is adjacent to the vertical passage portion 441 is smaller than a width of the other end thereof that is distal to the vertical passage portion 441.

Since the largest diameter of the cover body 42 is greater than the largest diameter of the base 2, when the drain strainer 100" is viewed from the top (see FIG. 11), the cover body 42 will completely cover the base 2 and the straining unit 3, so that the user (P) can only see the cover body 42 and the guide passage 44. Further, since the cover body 42 has a material similar to that of the sink body 11, it is difficult to discover that the drain strainer 100" is installed in the sink 1, so that an overall aesthetics can be improved. Moreover, since water must pass through two straining passages, that is, the main straining holes 34 and the bottom straining holes 32, before it flows out of the drain strainer 100", clogging of the drain pipe can be prevented, so that the problem of poor filtering effect and easy clogging encountered by the currently available drain strainer for the wash basin can be resolved.

Additionally, since the width of one end of the inclined passage portion 442 that is adjacent to the vertical passage portion 441 is smaller than the width of the other end thereof that is distal to the vertical passage portion 441, when water enters the guide passage 44, it can produce a strong impulse to accelerate the drain speed.

It is worth to mention herein that by threadedly connecting the connecting portion 41 of the cover unit 4 with the engaging portion 35 of the straining unit 3, and because the main straining surrounding wall 332 can be positioned in the positioning groove 313 of the bottom straining member 31 through the height difference (d) between the top surface 311 of the bottom straining member 31 and the groove bottom wall 315, the cover unit 4 and the main straining member 33 of this disclosure will not easily tip over, thereby preventing the cover body 42 from falling over and hitting the sink body 11 which can cause damage thereto. The advantages of the first embodiment can be similarly achieved using the third embodiment.

Figure 12:
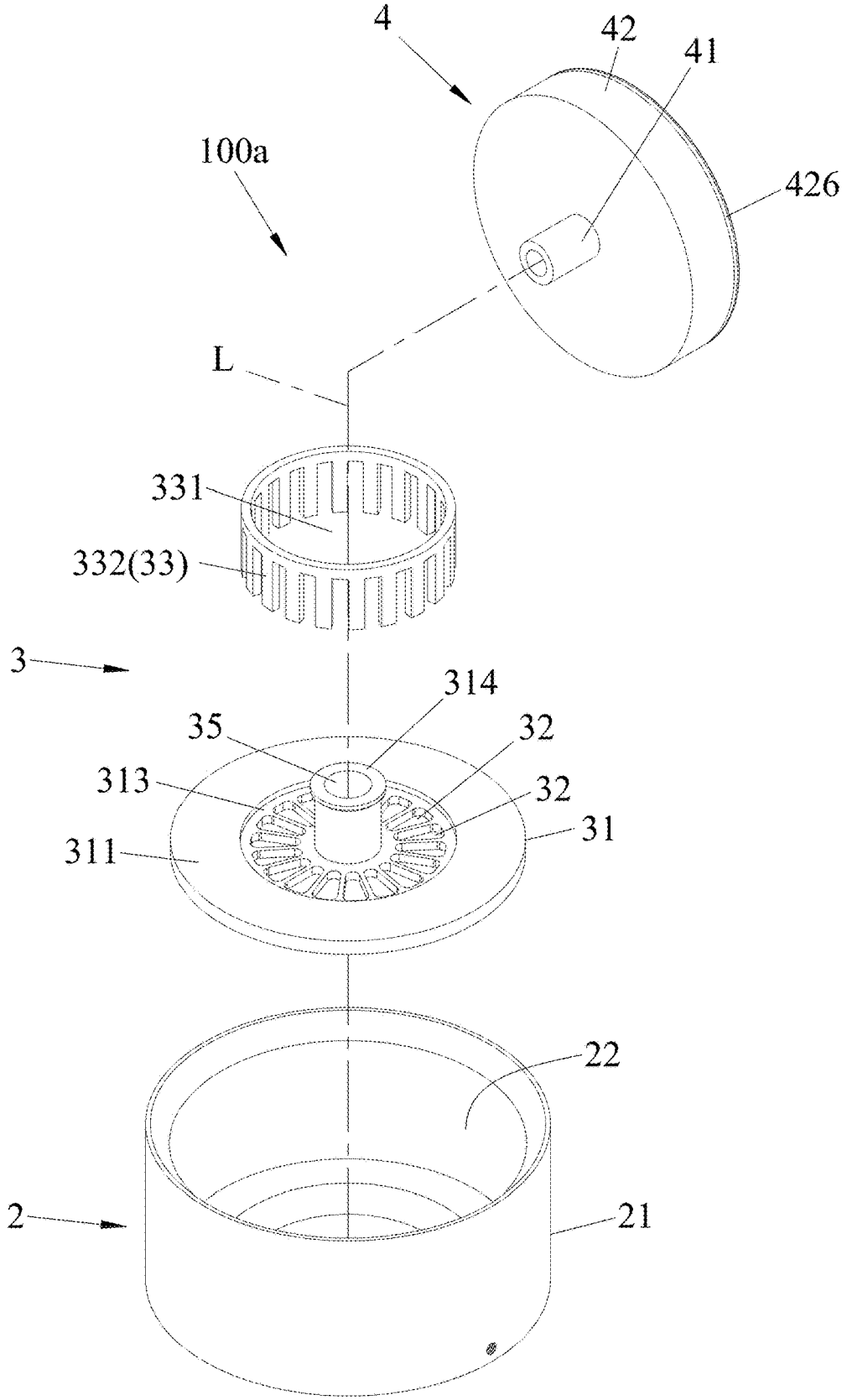
FIG. 12 is an exploded perspective view of a drain strainer according to the fourth embodiment of the present disclosure.

Referring to FIG. 12, the fourth embodiment of the drain strainer (100*a*) of this disclosure is shown to be identical to the first embodiment, but differs in that, the main straining member 33 of the drain strainer (100*a*) of the fourth embodiment is only provided with the main straining surrounding wall 332, and is formed with only one overflow hole 331. The overflow hole 331 is defined by the main straining surrounding wall 332. Further, the engaging portion 35 of the straining unit 3 is provided on the grip portion 314 of the bottom straining member 31, and is configured as a groove. The connecting portion 41 of the cover unit 4 is inserted into the engaging portion 35.

When it is desired to clean the drain strainer (100*a*), the cover unit 4 is simply pulled upward to bring therealong the main straining member 33, after which the fingers of the user (P) can be inserted into the chamber 22 to remove the hair or debris accumulated on the top surface 311 of the bottom straining member 31.

The advantages of the first embodiment can be similarly achieved using the fourth embodiment.

Figure 13:
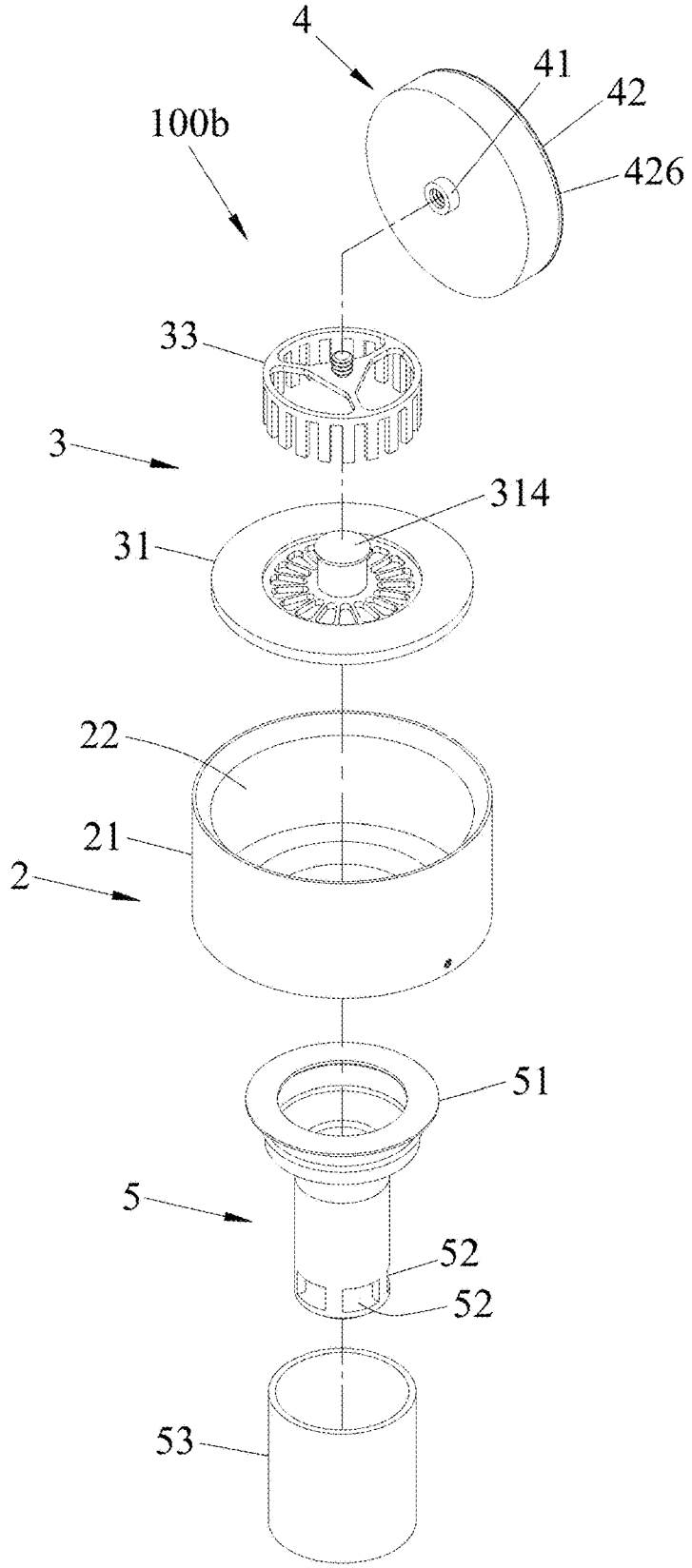
FIG. 13 is an exploded perspective view of a drain strainer according to the fifth embodiment of the present disclosure.
Figure 14:
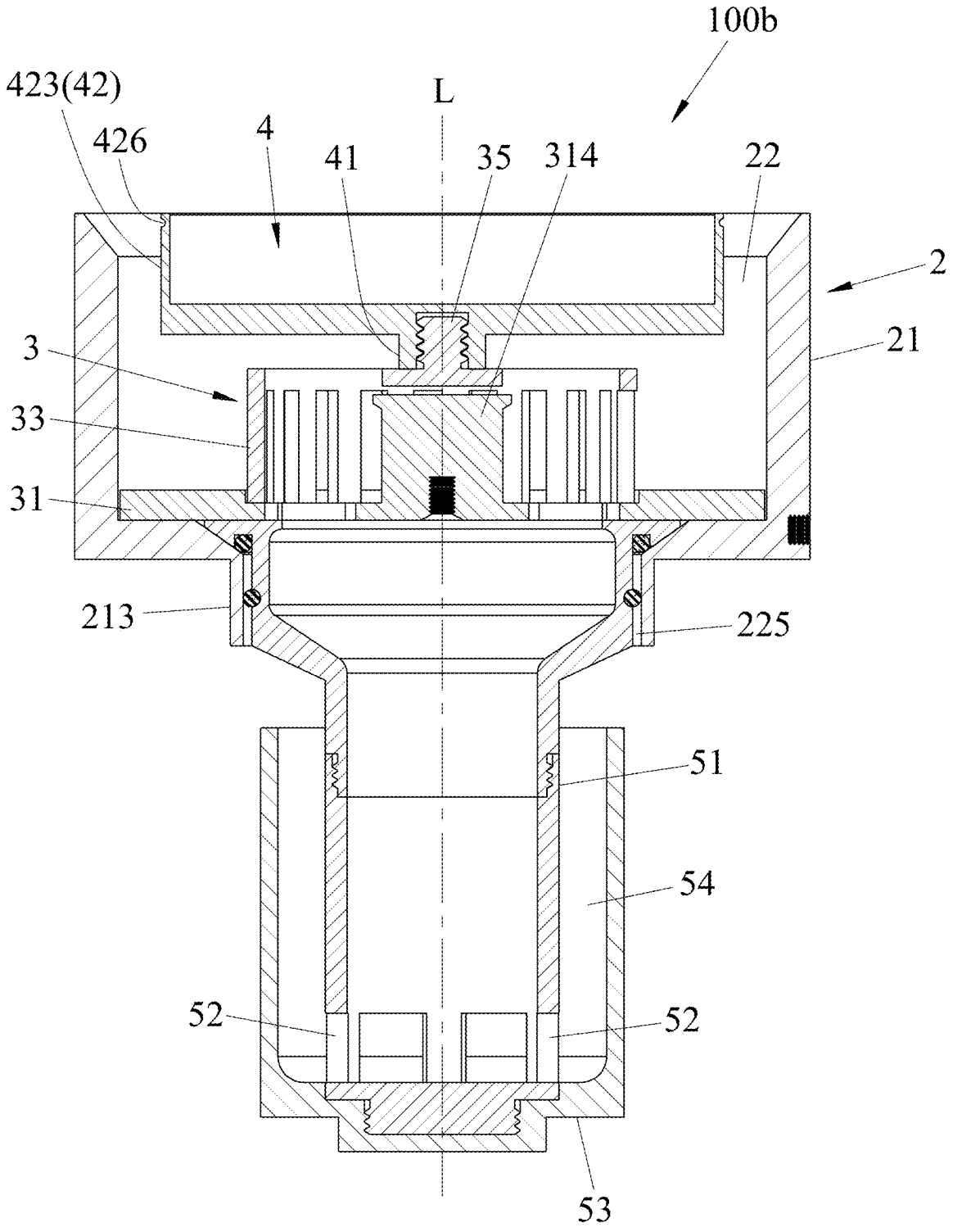
FIG. 14 is an assembled sectional view of the fifth embodiment.

Referring to FIGS. 13 and 14, the fifth embodiment of the drain strainer (100*b*) of this disclosure is shown to be identical to the first embodiment, but differs in that, the drain strainer (100*b*) of the fifth embodiment further comprises a water seal unit 5 which includes a connecting member 51 and a cylindrical sleeve member 53. The connecting member 51 is disposed in the annular extension 213 of the base 2, and has an upper portion airtightly connected to the annular extension 213, and a lower portion formed with a plurality of angularly spaced-apart water guide holes 52. The sleeve member 53 is sleeved on the connecting member 51, and is connected to the lower portion of the connecting member 51.

An S-shaped water seal passage 54 is formed between the connecting member 51 and the sleeve member 53. Through the S-shaped water seal passage 54, a portion of the water can be retained in the water seal passage 54 to prevent gas in the drain pipe (not shown) from entering a room through the drain strainer (100*b*).

The advantages of the first embodiment can be similarly achieved using the fifth embodiment.

Figure 15:
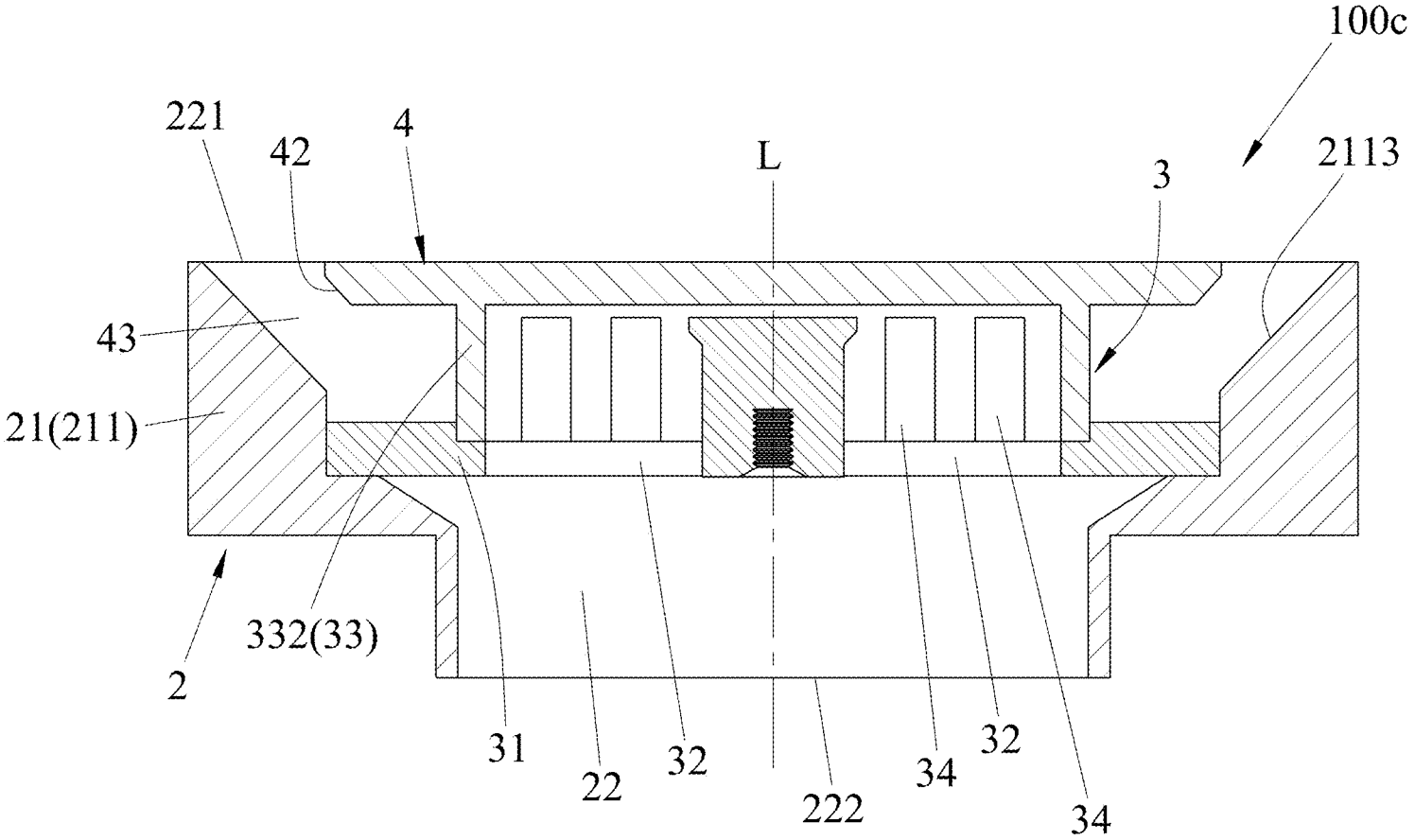
FIG. 15 is an assembled sectional view of a drain strainer according to the sixth embodiment of the present disclosure.

Referring to FIG. 15, the sixth embodiment of the drain strainer (100*c*) of this disclosure is shown to be identical to the first embodiment, but differs in that, in the sixth embodiment, the cover body 42 of the cover unit 4 is directly connected to the main straining surrounding wall 332 of the main straining member 33. That is, the cover unit 4 is integrally connected as one piece with the main straining member 33. Thus, in this embodiment, the main straining member 33 does not have the main straining top wall 333 (see FIG. 2) and the overflow holes 331 (see FIG. 2), the straining unit 3 does not have the engaging portion 35, and the cover unit 4 does not have the connecting portion 41 (see FIG. 2). The annular water passage 43 is cooperatively defined by the outer surface of the cover body 42 and the top edge surface 2113 of the base surrounding wall 211 of the base body 21, and communicates with the main straining holes 34.

In use, when the main straining holes 34 are clogged, the cover unit 4 together with the main straining member 33 is pulled out by the user, so that water can flow through the bottom straining holes 32 of the bottom straining member 31 and out into the drain pipe (not shown). The cover unit 4 together with the main straining member 33 is cleaned, and the filtered hair or debris is removed therefrom. Thus, it can be ensured that all water must flow through two filtering or straining passages, that is, the main straining holes 34 and the bottom straining holes 32, which have different extending directions, so that clogging of the drain pipe can be reduced.

Because the cover body 42 of the cover unit 4 is directly connected to the main straining surrounding wall 332 of the main straining member 33, the number of components of the drain strainer (100*c*) can be minimized, thereby making the manufacture and assembly thereof more efficient. The advantages of the first embodiment can be similarly achieved using the sixth embodiment.

Figure 16:
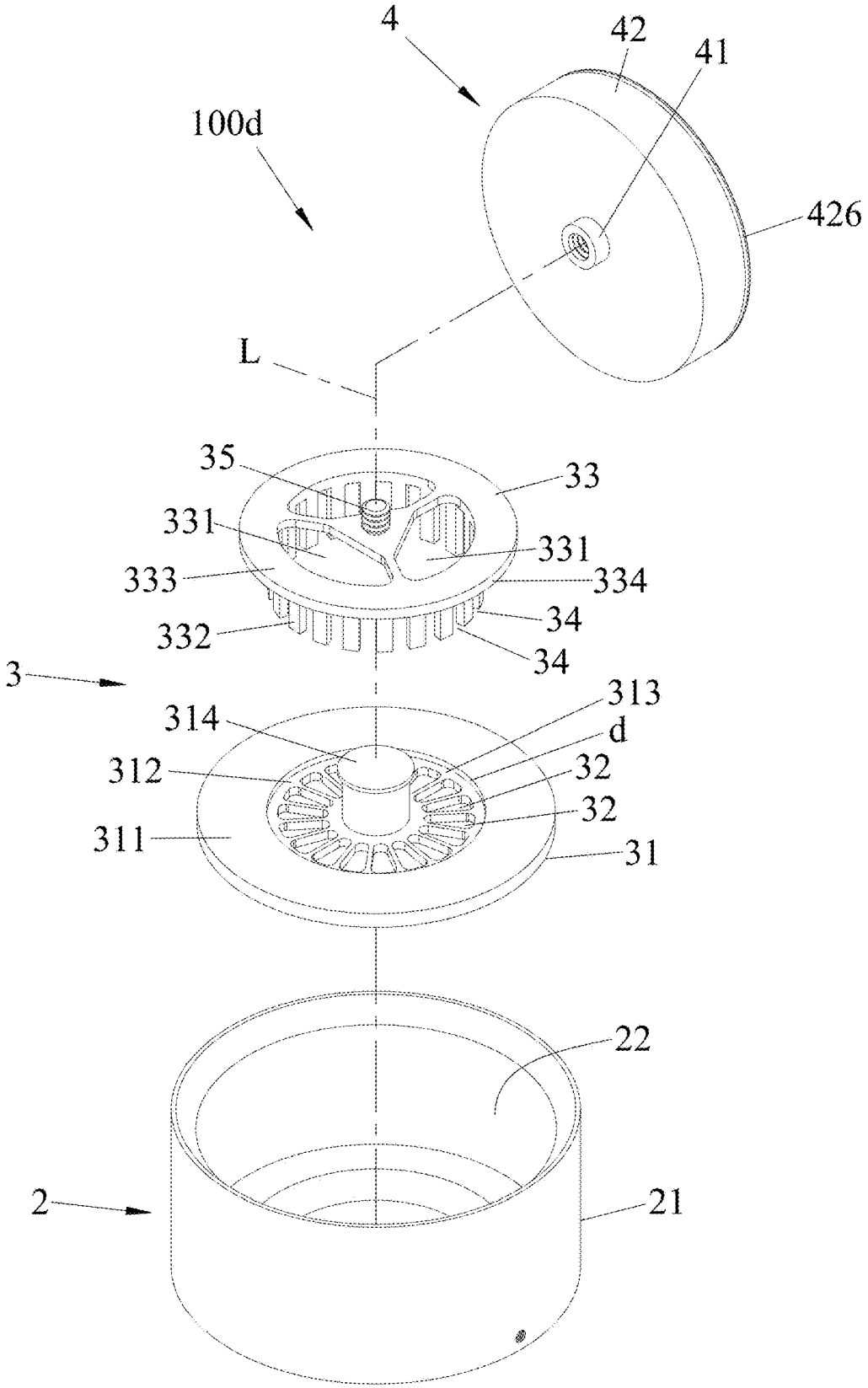
FIG. 16 is an exploded perspective view of a drain strainer according to the seventh embodiment of the present disclosure.
Figure 17:
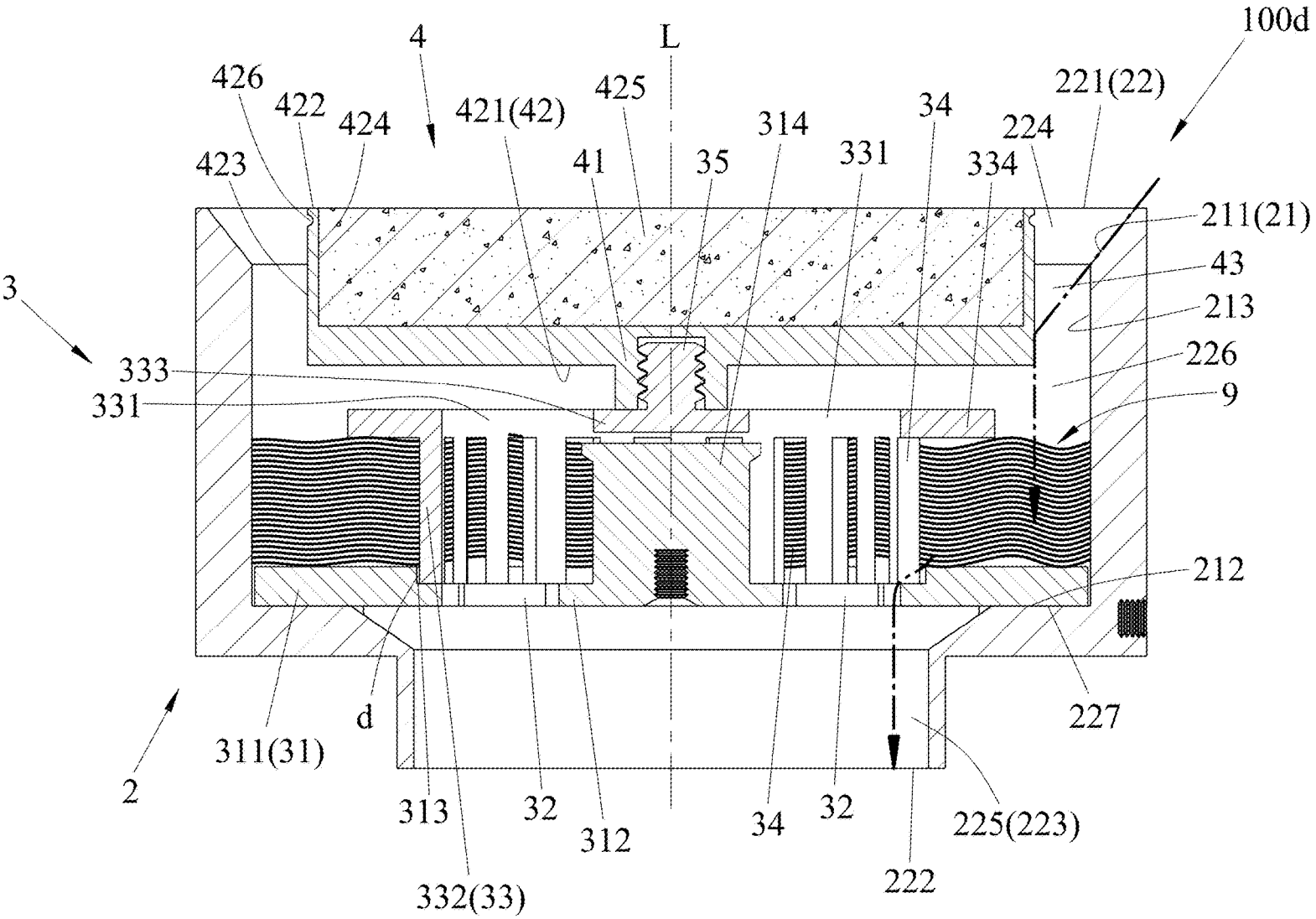
FIG. 17 is an assembled sectional view of the seventh embodiment.

Referring to FIGS. 16 and 17, the seventh embodiment of the drain strainer (100*d*) of this disclosure is shown to be identical to the first embodiment, but differs in that, in the seventh embodiment, the main straining member 33 further includes an annular flange 334 extending outwardly and radially from an outer periphery of the main straining top wall 333.

When the hair 9 is accumulated on the top surface 311 of the bottom straining member 31 and clogs the main straining holes 34, water will flow out of the drain strainer (100*d*) through the overflow holes 331 and the bottom straining holes 32. With the provision of the annular flange 334 in this embodiment, most of the hair 9 in the water is retained under the annular flange 334, thereby preventing the hair 9 from flowing out of the overflow holes 331 and clogging the drain pipe (not shown). The advantages of the first embodiment can be similarly achieved using the seventh embodiment.

In summary, through the disposition of the main straining member 33 and the bottom straining member 31, water flowing through the drain strainer 100, 100', 100", 100*a*, 100*b*, 100*c*, 100*d* of this disclosure passes through two filtering or straining passages, that is, the main straining holes 34 and the bottom straining holes 32. Further, with the extending directions of the main straining holes 34 and the bottom straining holes 32 being different, the filtering or straining effect of this disclosure can be enhanced, thereby reducing clogging of the drain pipe. Therefore, the object of this disclosure can indeed be achieved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A drain strainer comprising:

a base having a base body that defines a chamber, said chamber having a water inlet and a water outlet opposite to each other along a top-bottom direction;

a straining unit disposed in said chamber and including a bottom straining member proximate to said water outlet and having a plurality of bottom straining holes extending therethrough, and a main straining member disposed on one side of said bottom straining member that is distal to said water outlet, said main straining member including a main straining surrounding wall formed with a plurality of spaced-apart main straining holes that extend therethrough, said bottom straining holes and said main straining holes communicating with each other and with said chamber; and a cover unit including a cover body connected to said straining unit;

wherein said bottom straining member is circular, and has a top surface, a bottom surface opposite to said top surface, and a groove extending inwardly from a central portion of said top surface and defined by a groove bottom wall and a groove surrounding wall, said top surface and said groove bottom wall having a height difference, said bottom straining holes being formed in said groove bottom wall, said main straining surrounding wall being positioned in said groove adjacent to said groove surrounding wall.

2. The drain strainer as claimed in claim 1, wherein said chamber includes a lower chamber portion having said water outlet, and an upper chamber portion communicating with said lower chamber portion and having said water inlet, said base body including a base surrounding wall that has an inner surface defining said upper chamber portion, an outer surface opposite to said inner surface, and a top edge surface tapering downwardly from a top periphery of said outer surface to a top periphery of said inner surface and defining said water inlet.

3. The drain strainer as claimed in claim 2, wherein said chamber further includes a shoulder between said lower chamber portion and said upper chamber portion, said lower chamber portion having a diameter smaller than a diameter of said upper chamber portion, said base body further including a base bottom wall extending inwardly and radially from a bottom periphery of said base surrounding wall and corresponding to said shoulder, and an annular extension extending downwardly from said base bottom wall and defining said lower chamber portion, said bottom straining member abutting against said base bottom wall, and having an outer diameter substantially the same as an inner diameter of said base surrounding wall.

4. A drain strainer comprising:

a base having a base body that defines a chamber, said chamber having a water inlet and a water outlet opposite to each other along a top-bottom direction;

a straining unit disposed in said chamber and including a bottom straining member proximate to said water outlet and having a plurality of bottom straining holes extending therethrough, and a main straining member disposed on one side of said bottom straining member that is distal to said water outlet, said main straining member including a main straining surrounding wall formed with a plurality of spaced-apart main straining holes that extend therethrough, said bottom straining holes and said main straining holes communicating with each other and with said chamber; and a cover unit including a cover body connected to said straining unit;

wherein said chamber includes a lower chamber portion having said water outlet, and an upper chamber portion communicating with said lower chamber portion and having said water inlet, said base body including a base surrounding wall that has an inner surface defining said upper chamber portion, an outer surface opposite to said inner surface, and a top edge surface tapering downwardly from a top periphery of said outer surface to a top periphery of said inner surface and defining said water inlet, and wherein said cover unit further includes a connecting portion extending outwardly from said cover body, and said cover body includes a cover bottom wall, and a cover surrounding wall extending upwardly from an outer periphery of said cover bottom wall, said connecting portion extending downwardly from said cover bottom wall, said cover surrounding wall having a smallest diameter greater than an outer diameter of said main straining member.

5. The drain strainer as claimed in claim 4, wherein an extending direction of said top edge surface of said base surrounding wall toward said water outlet intersects with said cover surrounding wall.

6. The drain strainer as claimed in claim 4, wherein said cover body is disposed in said chamber and cooperates with said base body to define an annular water passage corresponding to said water inlet.

7. The drain strainer as claimed in claim 6, wherein said cover body partially covers said straining unit.

8. The drain strainer as claimed in claim 4, wherein said drain strainer is suitable to be disposed in a drain opening of a sink body of a sink, said cover body being disposed externally of said chamber, and having a largest diameter greater than a largest diameter of said base body to completely cover said straining unit, said cover body being configured to cooperate with the sink body to define an annular guide passage communicating with said water inlet.

9. The drain strainer as claimed in claim 8, wherein said annular guide passage has a vertical passage portion extending along the top-bottom direction and adjacent to said cover surrounding wall, and an inclined passage portion extending upwardly, outwardly and inclinedly from said vertical passage portion.

10. The drain strainer as claimed in claim 1, wherein cover unit further includes a connecting portion extending outwardly from said cover body, and said straining unit further includes an engaging portion for engagement with said connecting portion.

11. The drain strainer as claimed in claim 10, wherein said main straining member further includes a main straining top wall connected to one side of said main straining surrounding wall that is opposite to said bottom straining member, said main straining top wall being formed with at least one overflow hole.

12. The drain strainer as claimed in claim 10, wherein said bottom straining member further has a grip portion protruding from said groove bottom wall along the top-bottom direction and surrounded by said bottom straining holes, said engaging portion being provided on said grip portion and being configured as a groove for receiving said connecting portion of said cover unit.

13. The drain strainer as claimed in claim 1, wherein said cover body is integrally connected as one piece with said main straining member, is disposed in said chamber, and cooperates with said base body to define an annular water passage corresponding to said water inlet.

14. The drain strainer as claimed in claim 11, wherein said main straining member further includes an annular flange extending outwardly and radially from an outer periphery of said main straining top wall.

* * * * *